US007365703B2

(12) United States Patent
Näsvall et al.

(10) Patent No.: US 7,365,703 B2
(45) Date of Patent: Apr. 29, 2008

(54) RADAR REFLECTOR

(75) Inventors: Alf Näsvall, Sundbyberg (SE); Gunnar Byström, Kungsängen (SE)

(73) Assignee: SAAB AB, Linköping (SE)

( * ) Notice: Subject to any disclaimer, the term of this patent is extended or adjusted under 35 U.S.C. 154(b) by 59 days.

(21) Appl. No.: 11/354,956

(22) Filed: Feb. 16, 2006

(65) Prior Publication Data

US 2006/0187110 A1 Aug. 24, 2006

(30) Foreign Application Priority Data

Feb. 23, 2005 (EP) ..... 05445008

(51) Int. Cl.
*H01Q 15/14* (2006.01)

(52) U.S. Cl. ..... 343/912

(58) Field of Classification Search ..... 343/912, 343/907, 706, 915; 342/7–10
See application file for complete search history.

(56) References Cited

U.S. PATENT DOCUMENTS 3,138,798 A 6/1964 Greenwood
3,221,333 A * 11/1965 Brown ..... 343/872
4,650,092 A 3/1987 Anderson et al.
4,901,081 A * 2/1990 Bain et al. ..... 342/8
5,457,472 A 10/1995 Bjordal et al.
6,784,825 B1 * 8/2004 Kubota et al. ..... 342/5
2002/0093460 A1 * 7/2002 Alexeff et al. ..... 343/901
2003/0107519 A1 * 6/2003 Snow et al. ..... 343/706

* cited by examiner

*Primary Examiner*—Huedung Mancuso
(74) *Attorney, Agent, or Firm*—Venable LLP; Eric J. Franklin

(57) ABSTRACT

A radar reflector including a first and a second radar corner. The radar corners are formed by an essentially rectangular first flat plate and a second and a third essentially flat plate arranged perpendicular to the first plate at two perpendicular edges of the first plate and to meet the two edges of the first plate. The second and the third plates of the first radar corner are arranged to meet two different perpendicular edges of the first plate than the second and third plate of the second radar corner. In order to obtain a less bulky storing and a more easily controlled ejection process the second and third plate of each radar corner are rotatable at the meeting edge of the first plate from a folded position in which the plates are essentially parallel with and close to the first plate to an unfolded position in which the plates are essentially perpendicular to the first plate.

14 Claims, 3 Drawing Sheets

RADAR REFLECTOR

CROSS-REFERENCE TO RELATED APPLICATIONS

This application claims priority under 35 USC § 119 to European patent application no. 05445008.5 filed on 23 Feb. 2006.

FIELD OF THE INVENTION

The present invention relates to a radar reflector comprising a first and a second radar corner, the radar corners being formed by an essentially rectangular first flat plate and a second and a third essentially flat plate arranged perpendicular to the first plate at two perpendicular edges of the first plate and to meet said two edges of the first plate, the second and the third plates of the first radar corner being arranged to meet two different perpendicular edges of the first plate than the second and third plate of the second radar corner.

BACKGROUND OF THE INVENTION

Radar reflectors are i. a. used for jamming and confusing enemies attacking a target such as an air plane or following the activity of potential targets. To meet the threat of an enemy a reflector or clusters of reflectors are ejected from the target. When a reflector according to the above is ejected from for example an air plane, the reflector performs a tumbling movement in the air and if illuminated reflects signals back to the illuminating source. The design of the reflector admits the reflector to return an incoming signal back to the source almost all the time during its tumbling.

A radar reflector according to the first paragraph is previously known from U.S. Pat. No. 3,138,798. The radar reflector is provided with two opposite directed radar corners and has assumed its final shape when manufactured. The reflectors are stack-stored in a group that may be stored in an essentially spherical configuration. One disadvantage with said known reflector arrangement is that it is difficult to control the number of reflectors ejected in other way than batchwise ejecting of spherical configurations. It is not possible to eject one single radar reflector or a part of the total number of reflectors within a spherical configuration. Furthermore the spherical configuration is rather bulky when stored in a dispenser before ejection.

SUMMARY OF THE INVENTION

The object of the invention is to obtain a less bulky storing of the radar reflectors and a radar reflector the ejection process of which is more easily controlled so that one single or a suitable chosen number of reflectors could be ejected at the same time.

The object of the invention is obtained in that the second and third plate of each radar corner are rotatable at the meeting edge of the first plate from a folded position in which the plates are essentially parallel with and close to the first plate to an unfolded position in which the plates are essentially perpendicular to the first plate.

By means of the invention a reflector is obtain that in its unfolded or expanded position presents a desired tumbling movement after ejection at the same time as a the reflector in its folded or non-expanded position occupies a minimum of space in dispensers common on the market, such as our BOL dispenser patented i.a. in U.S. Pat. No. 4,650,092.

In this connection it could be noted that unfoldable reflectors as such are previously known, see for example U.S. Pat. No. 5,457,472. However, these known reflectors are not of the tumbling type and there are no particular measures disclosed concerning the ejection control of one or more reflectors.

According to one favourable embodiment of the radar reflector a pre-tensioned torsion spring is arranged to obtain the rotation of the second and third plates from the folded position to the unfolded position. The introduction of a pre-tensioned torsion spring offers a simple way to obtain the desired movement of the first and second plates from the folded position to the unfolded position within a restricted time limit.

According to an advantageous development of the radar reflector, the torsion spring arrangement is arranged to follow two perpendicular meeting edges of the first plate and an edge of the second and third plates perpendicular to the meeting edge associated with the respective second and third plates. The spring arrangement is compact and results in an even loading of the plates involved.

According to a further advantageous development of the radar reflector, the torsion spring is moulded into a plastic material applied to the edges of the second and third plates housing the torsion spring. Use of plastic material moulding makes the radar reflector easy to manufacture and is space saving.

According to another advantageous development of the radar reflector stop elements are arranged to stop the second and third plates in the unfolded position. According to one favourable embodiment in this connection the stop elements comprise a strip connecting the first plate with the second and third plate. In a more detailed embodiment the ends of the strip are connected to a respective of two perpendicular edges of the first plate and the second and third plates are provided with guiding elements guiding the movement of the strip.

According to still a further embodiment the second and third plates are connected to the edges of the first plate by means of hinges. The stop elements may in such a case comprise stop lugs integrated with the hinges. Furthermore according to still another embodiment the second and third plates are connected to each other by means of hinges.

In order to enhance the radar reflector jamming and confusion activities further it is according to yet another embodiment proposed that the first plate is provided with an actively-controlled reflecting surface on each side of the plate.

The plates may be made of metal and at least the second and the third plate may be made of perforated metal. Alternatively the second and third plate are made of metal covered plastic or paper material.

Preferably the second and third plates are shaped essentially rectangular with an extension coinciding with the extension of the first plate.

BRIEF DESCRIPTION OF THE DRAWINGS

The invention will now be described in more detail with reference to the accompanying drawings in which.

Figure 1:
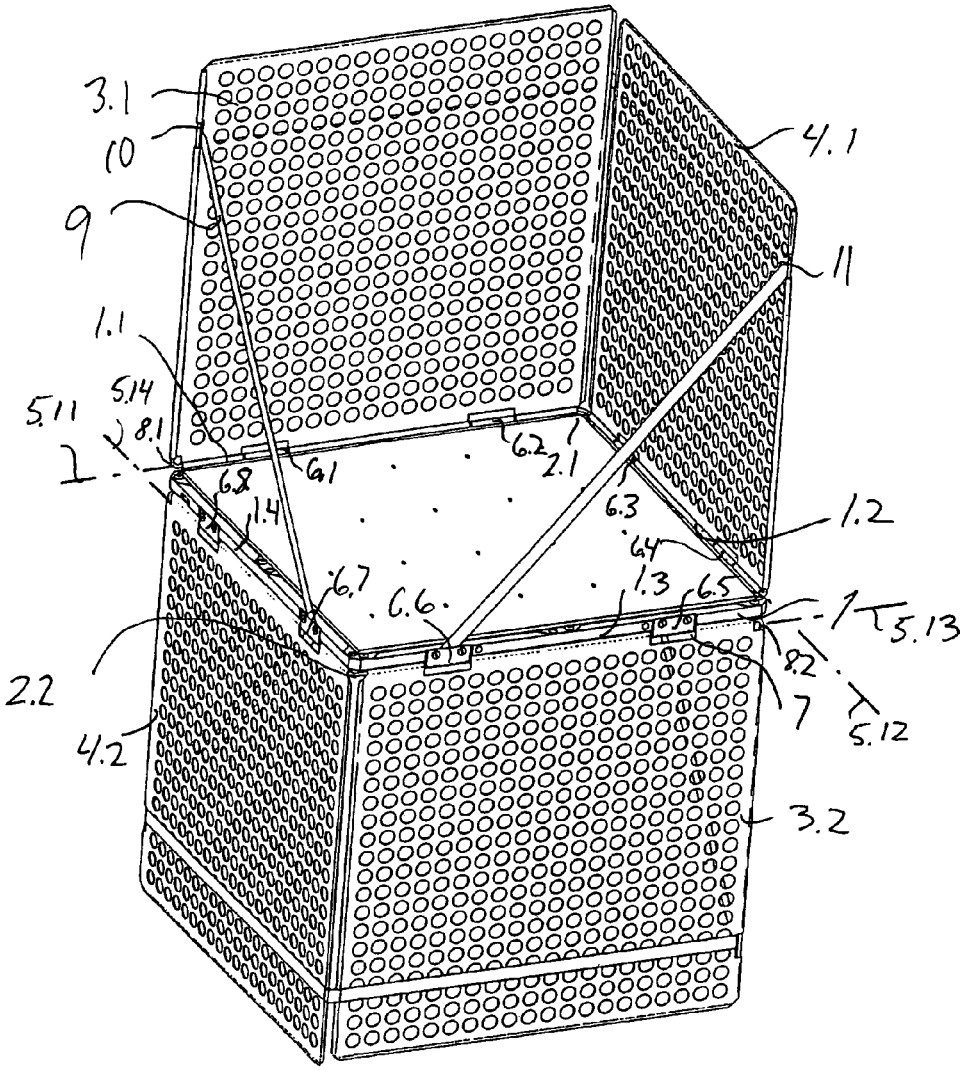
FIG. 1 is a schematic perspective view of a radar reflector embodiment according to the invention in an unfolded position.

The radar reflector shown in FIG. 1 comprises a first plate 1 common for a first radar corner 2.1 and a second radar corner 2.2. The plate is essentially rectangular. A radar corner is created by means of a second and a third essentially flat plate 3.1 and 4.1 in cooperation with the first plate 1 for the upper radar corner 2.1 and second and third plates 3.2 and 4.2 for the second corner 2.2. The second plate 3.1 of the first radar corner 2.1 is arranged to rotate around an axis 5.11 located at an edge 1.1 of plate 1 where the plate 1 and the second plate 3.1 are met. The third plate 4.1 of the first radar corner is arranged to rotate around an axis 5.12 located at an edge 1.2 of plate 1 where the plate 1 and the second plate 4.1 are met. The second plate 3.2 of the second radar corner 2.2 is arranged to rotate around an axis 5.13 located at an edge 1.3 of plate 1 where the plate 1 and the second plate 3.2 are met. The third plate 4.2 of the second radar corner is arranged to rotate around an axis 5.14 located at an edge 1.4 of plate 1 where the plate 1 and the second plate 4.2 are met. In the shown embodiment the rotation of the second and third plates around the axes are carried out by means of hinges 6.1-6.8. Each hinge comprises an element provided with a hole 7. A torsion spring 8.1 common to all hinges 6.1-6.4 of the first radar corner passes through the holes of the elements of the first radar corner. A torsion spring 8.2 common to all hinges 6.5-6.8 of the second radar corner passes through the holes of the elements of the second radar corner.

Figure 3:
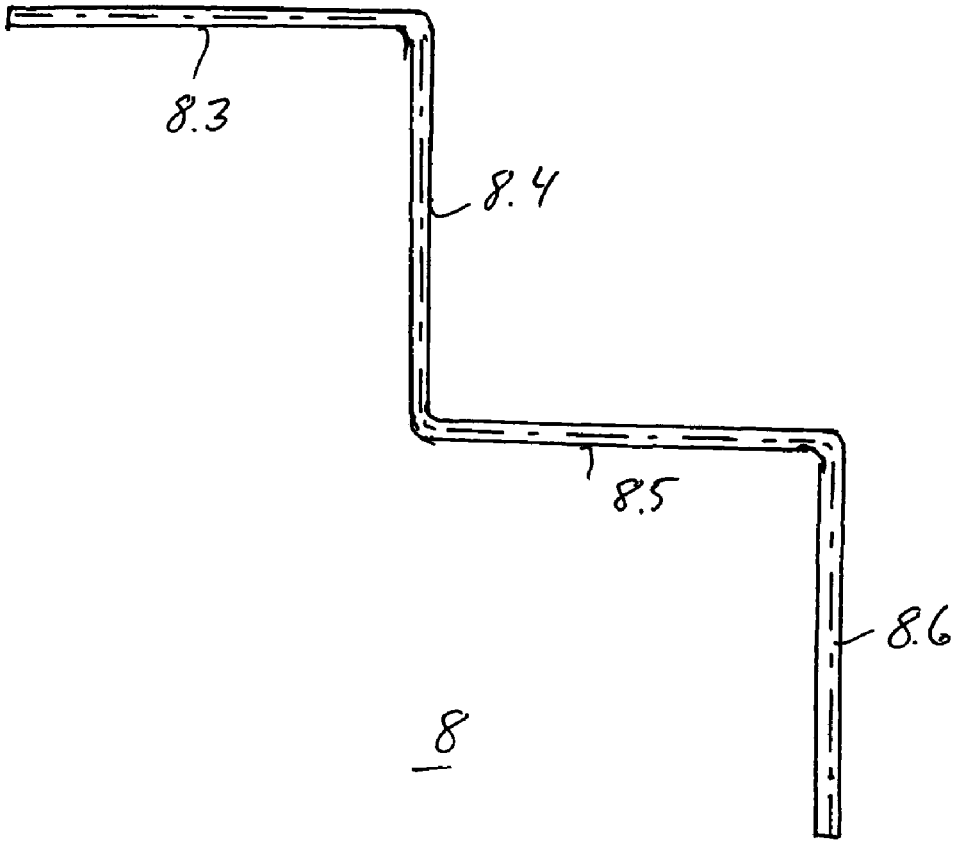
FIG. 3 is a plan view of a torsion spring to be used in the radar reflector.

The embodiment of the torsion springs 8.1 and 8.2 is shown as a separate component in FIG. 3. Preferably the spring 8 comprises four essentially straight sections 8.3, 8.4, 8.5 and 8.6. Each section preferably has an essentially circular cross section. The straight sections 8.4 and 8.5 are arranged to cooperate and form hinges together with the hole provided elements along the edges 1.1-1.4 of the plate 1. The straight sections 8.3 and 8.6 are each connected to an edge of the second or third plate, respectively, as indicated in FIG. 1.

Figure 2:
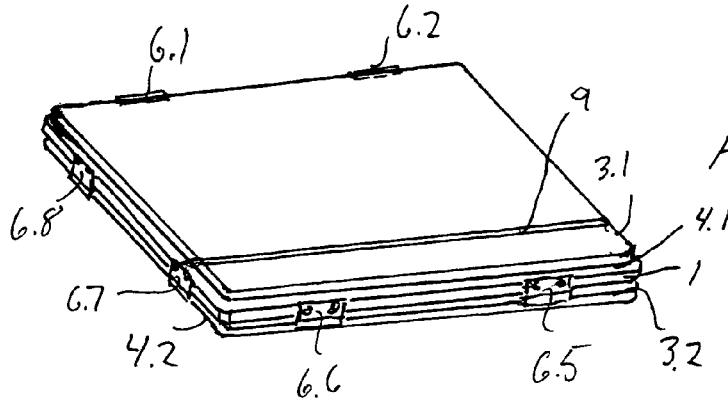
FIG. 2 is a schematic perspective view of the radar reflector embodiment according to FIG. 1 in a folded position.
Figure 4:
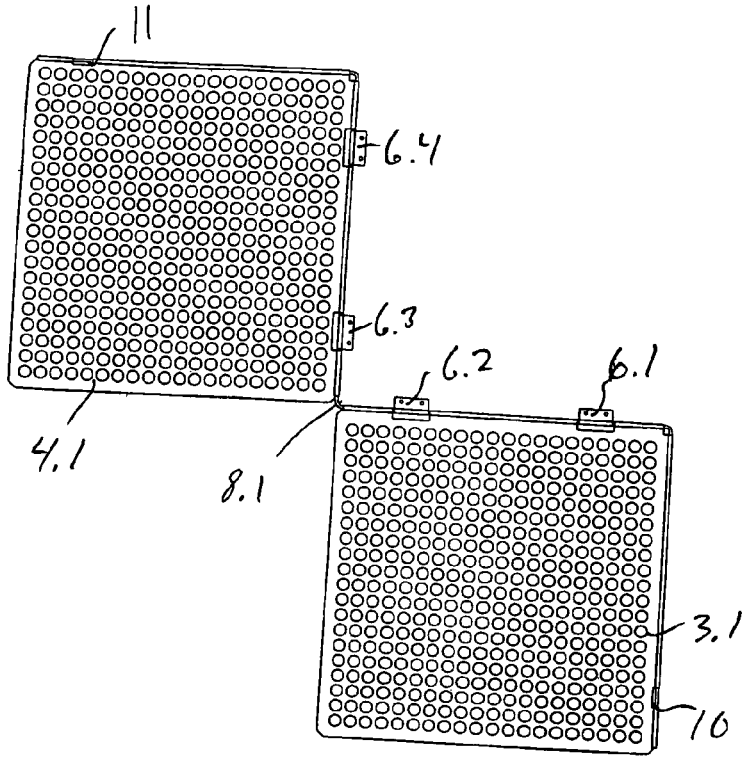
FIG. 4 is a plan view of the torsion spring according to FIG. 3 connected to rotatable plates comprised in the radar reflector according to the invention.
Figure 5:
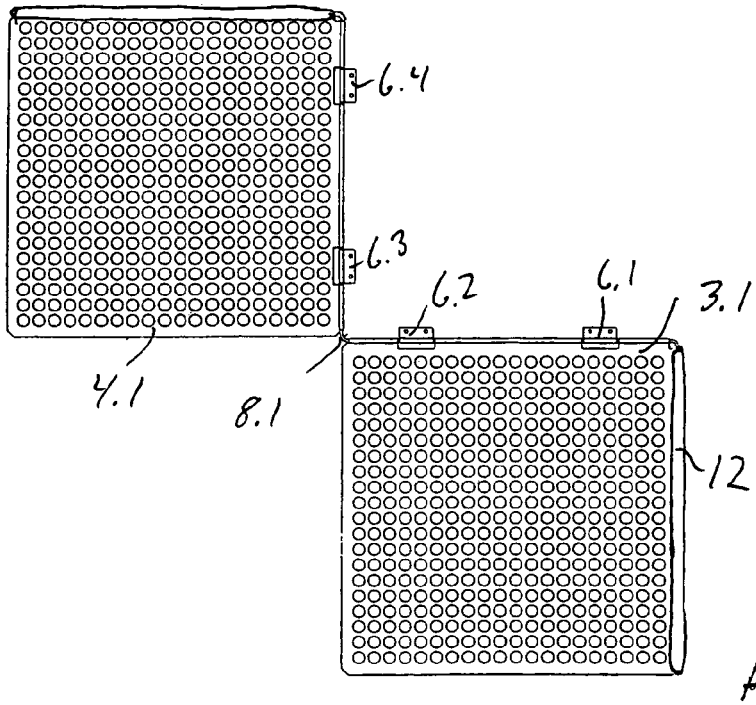
FIG. 5 is a plan view of an alternative embodiment of the torsion spring connection to the rotatable plates comprised in the radar reflector according to the invention.

The torsion springs 8.1 and 8.2 struggle to rotate the second and third plate from the folded position shown in FIG. 2 to a position in which the first, second and third plates are located in essentially the same plane, see FIG. 4 or 5. The second and third plates are to be stopped half-way in its rotation to form a right-angled corner 2.1, 2.2. In the embodiment shown in FIG. 1 this is solved by a strip 9 connecting the first plate 1 with the second and third plates 2, 3. The strip 9 is guided by means of guiding elements 10, 11. The guiding elements may have the shape of an opening or eye located close to an edge of the plates 3.1 and 4.1 as shown in FIG. 1. Other solutions to stop the rotation of the second and third plates are possible. For example the stop may be included in the hinges.

According to the embodiment shown in FIG. 5 the torsion spring is moulded into plastic material 12 applied to the edges of the second and third plates. In this connection examples of plastic material that could be used are thermoplastic resin, PCB materials (Printed Circuit Board materials) and carbon fibre materials.

It is also possible to arrange for a connection between the second and third plates (3.1, 4.1; 3.2, 4.2) for example by means of hinges. This has not been shown explicitly in the figures. If such a connection is introduced the second and third plates are suitably provided with foldings. Examples of how to arrange for folding of second and third plates are given in our simultaneously filed patent application (our ref 3992).

The radar reflector according to the invention is not limited to the embodiments described above, but can be modified within the framework of the following claims and concept of the invention.

The invention claimed is:

1. A radar reflector, comprising:

a first and a second radar corner, the radar corners being formed by an essentially rectangular first flat plate and a second and a third essentially flat plate arranged perpendicular to the first plate at two perpendicular edges of the first plate and to meet said two edges of the first plate, the second and the third plates of the first radar corner being arranged to meet two different perpendicular edges of the first plate than the second and third plate of the second radar corner, wherein the second and third plate of each radar corner are rotatable at the meeting edge of the first plate from a folded position in which the plates are essentially parallel with and close to the first plate to an unfolded position in which the plates are essentially perpendicular to the first plate; and a pre-tensioned torsion spring arranged to obtain the rotation of the second and third plates from the folded position to the unfolded position.

2. The radar reflector according to claim 1, wherein the torsion spring is arranged to follow two perpendicular meeting edges of the first plate and an edge of the second and third plates perpendicular to the meeting edge associated with the respective second and third plates.

3. The radar reflector according to claim 1, wherein the torsion spring is moulded into a plastic material applied to the edges of the second and third plates housing the torsion spring.

4. The radar reflector according to claim 1, wherein the second and third plates are connected to the edges of the first plate by means of hinges.

5. The radar reflector according to claim 1, wherein the second and third plates are connected to each other by means of hinges.

6. The radar reflector according to claim 1, wherein the first plate is provided with an actively-controlled reflecting surface on each side of the plate.

7. The radar reflector according to claim 1, wherein the plates are made of metal.

8. The radar reflector according to claim 6, wherein at least the second and the third plate are made of perforated metal.

9. The radar reflector according to claim 1, wherein the second and third plate are made of metal covered plastic or paper material.

10. The radar reflector according to claim 1, wherein the second and third plates are shaped essentially rectangular with an extension coinciding with the extension of the first plate.

11. A radar reflector, comprising:

a first and a second radar corner, the radar corners being formed by an essentially rectangular first flat plate and a second and a third essentially flat plate arranged perpendicular to the first plate at two perpendicular edges of the first plate and to meet said two edges of the first plate, the second and the third plates of the first radar corner being arranged to meet two different perpendicular edges of the first plate than the second and third plate of the second radar corner, wherein the second and third plate of each radar corner are rotatable at the meeting edge of the first plate from a folded position in which the plates are essentially parallel with and close to the first plate to an unfolded position in which the plates are essentially perpendicular to the first plate; and stop elements are arranged to stop the second and third plates in the unfolded position.

12. The radar reflector according to claim 11, wherein the stop elements comprise a strip connecting the first plate with the second and third plate.

13. The radar reflector according to claim 12, wherein the ends of the strip are connected to a respective of two perpendicular edges of the first plate and that the second and third plates are provided with guiding elements guiding the movement of the strip.

14. The radar reflector according to claim 11, wherein the stop elements comprise stop lugs integrated with the hinges.

* * * * *